US007296715B1

(12) United States Patent
Jerome

(10) Patent No.: US 7,296,715 B1
(45) Date of Patent: Nov. 20, 2007

(54) ERGONOMIC THIMBLE

(76) Inventor: G. Victoria Jerome, 530 Peregrine Cir., Longmont, CO (US) 80501

( * ) Notice: Subject to any disclaimer, the term of this patent is extended or adjusted under 35 U.S.C. 154(b) by 26 days.

(21) Appl. No.: 11/348,688

(22) Filed: Feb. 7, 2006

(51) Int. Cl.
*D05B 91/04* (2006.01)

(52) U.S. Cl. ..... 223/101

(58) Field of Classification Search ..... 223/99, 223/101; 2/21; 7/121; 30/127
See application file for complete search history.

(56) References Cited

U.S. PATENT DOCUMENTS

| | | | | |
|---|---|---|---|---|
| 190,897 | A | 5/1877 | Porter et al. | |
| 260,695 | A * | 7/1882 | Lubin | 223/101 |
| 534,211 | A | 2/1895 | English | |
| 1,522,484 | A | 1/1925 | Baker | |
| D150,696 | S | 8/1948 | Howser | |
| 2,494,439 | A * | 1/1950 | Gorka et al. | 7/121 |
| 2,568,951 | A | 9/1951 | Cudly | |
| 2,588,528 | A * | 3/1952 | Howser | 223/101 |
| 2,953,286 | A | 9/1960 | Fowler | |
| 3,531,029 | A * | 9/1970 | Lee | 223/101 |
| 3,722,763 | A | 3/1973 | Heinz | |
| 4,102,479 | A | 7/1978 | Braley | |
| 4,149,661 | A | 4/1979 | Curtiss | |
| 4,694,843 | A | 9/1987 | Casenhiser | |
| 4,955,515 | A * | 9/1990 | Brull | 223/101 |
| D409,829 | S | 5/1999 | Hanner | |
| 6,726,068 | B2 | 4/2004 | Miller | |

* cited by examiner

*Primary Examiner*—Gary L. Welch
*Assistant Examiner*—Andrew W Sutton
(74) *Attorney, Agent, or Firm*—Emery L. Tracy

(57) ABSTRACT

A thimble device for protecting fingers and thumb from a needle during a sewing operation is provided. The thimble device comprises a top needle bearing surface having a dimple formed therein and two side surfaces with each side surface having an angled portion and a curved portion. The curved portions are sized and shaped for receiving a portion of the fingers when the thimble device is seated between the fingers. The thimble device further includes an angled front surface, an angled rear surface, and a curved bottom surface sized and shaped for receiving a portion of the thumb.

20 Claims, 2 Drawing Sheets

ERGONOMIC THIMBLE

BACKGROUND OF THE INVENTION

1. Field of the Invention

This invention relates generally to a thimble and, more particularly, the invention relates to an ergonomic thimble allowing a user to always maintain a sewing needle in hand while wearing the ergonomic thimble in the user's dominant hand for better maneuverability and keeping the user's other hand free for holding and manipulating the fabric or project with maximum efficiency.

2. Description of the Prior Art

It is well known in the art that hand sewing can require a considerable amount of repetitive force to be applied to a sewing needle by a finger in order to stitch fabric. Finger protective devices and thimbles have long been used for their ability to prevent injury to the fingers during stitching operation, especially with heavy fabrics. Among the earliest examples of thimbles is a somewhat truncated conical shaped metal cap designed to slip over and be adhered to the end of the sewing digit by frictional means. The top and sides of the thimble are dimpled to receive the end of the needle and prevent slippage as force is applied. Unfortunately, these small dimples rapidly become either filled with dirt or grime or else the dimples are not deep enough to adequately engage the eye end of needles when considerable pressure is applied in order to force them through the fabric being sewn. Such thimbles are in use even today.

It is often difficult to keep the needle in hand when using a thimble. Sometimes, the user will stop to put the thimble on, push the needle through, and then remove the thimble to grab the needle once more. Alternatively, the user wears the thimble on the opposite hand and continues to work uninterrupted. Unfortunately, this means that the thimble is not being worn on the user's dominant hand and sewing efficiency is compromised.

In addition, while it is sometimes awkward to manage the fabric or project while wearing a conventional thimble, it can also be painful if the conventional thimble fits too tight or if there is a health problem such as arthritis affecting the user's fingers or hands. Wearing the thimble over a thumb or finger can be problematic for persons with digits that are smaller, or more likely, larger than the typical "one size fits all" thimble. Or, a nice manicure can make wearing the typical thimble impractical.

Accordingly, there exists a need for an ergonomic thimble which allows a user to always maintain a sewing needle in hand. Additionally, a need exists for an ergonomic thimble which can be worn on the user's dominant hand for better maneuverability. Furthermore, there exists a need for an ergonomic thimble which keeps the user's other hand free for holding and manipulating the fabric or project with maximum efficiency.

SUMMARY

The present invention is a thimble device for protecting fingers from a needle during a sewing operation. The thimble device comprises a top needle bearing surface and two side surfaces with each side surface having a curved portion for receiving a portion of the fingers. The thimble device further includes a front surface, a rear surface, and a bottom surface.

In addition, the present invention includes a thimble device for protecting fingers and thumb from a needle during a sewing operation. The thimble device comprises a top needle bearing surface having a dimple formed therein and two side surfaces with each side surface having an angled portion and a curved portion. The curved portions are sized and shaped for receiving a portion of the fingers when the thimble device is seated between the fingers. The thimble device further includes an angled front surface, an angled rear surface, and a curved bottom surface sized and shaped for receiving a portion of the thumb.

The present invention further includes a method for using the thimble device for protecting a hand during sewing operations with the hand having an index finger, a middle finger, and a thumb. The method comprises positioning the thimble device between the index finger and the middle finger, resting a portion of the index finger in the curved portion of one of the side surfaces, resting a portion of the middle finger in the curved portion of the other side surface, seating a portion of the thumb into the curved bottom surface, positioning an eye end of the needle in the dimple, and applying pressure to the needle.

DETAILED DESCRIPTION OF THE PREFERRED EMBODIMENTS

Figure 1:
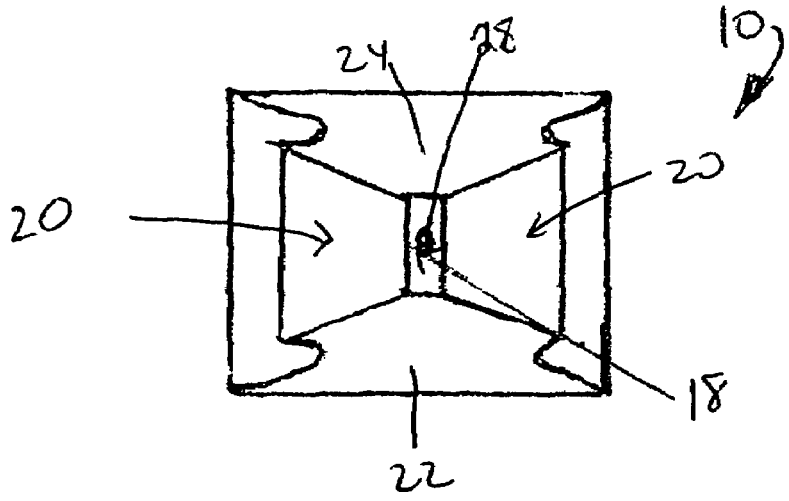
FIG. 1 is a top plan view illustrating an ergonomic thimble, constructed in accordance with the present invention.

As illustrated in FIGS. 1-5, the present invention is an ergonomic thimble, indicated generally at 10, for sewing with a sewing needle 12, thread 14 within the sewing needle 12, and fabric 16. The ergonomic thimble 10 of the present invention allows a user to always maintain the sewing needle 12 in hand while wearing the ergonomic thimble 10 in the user's dominant hand for better maneuverability and keeping the user's other hand free for holding and manipulating the fabric 16 or project with maximum efficiency.

The ergonomic thimble 10 of the present invention is preferably constructed from a durable material including, but not limited to, wood, plastic, metal, ceramics, etc. The ergonomic thimble 10 preferably has a height of approximately 1.125 inches, a width of approximately 0.4375 inches, and a depth of approximately 0.75 inches. It should be noted that while specific heights, widths, and depths of the ergonomic thimble 10 have been described and illustrated herein, it is within the scope of the present invention for the ergonomic thimble to have any height, width, or depth, depending on the desires of the user.

Figure 2:
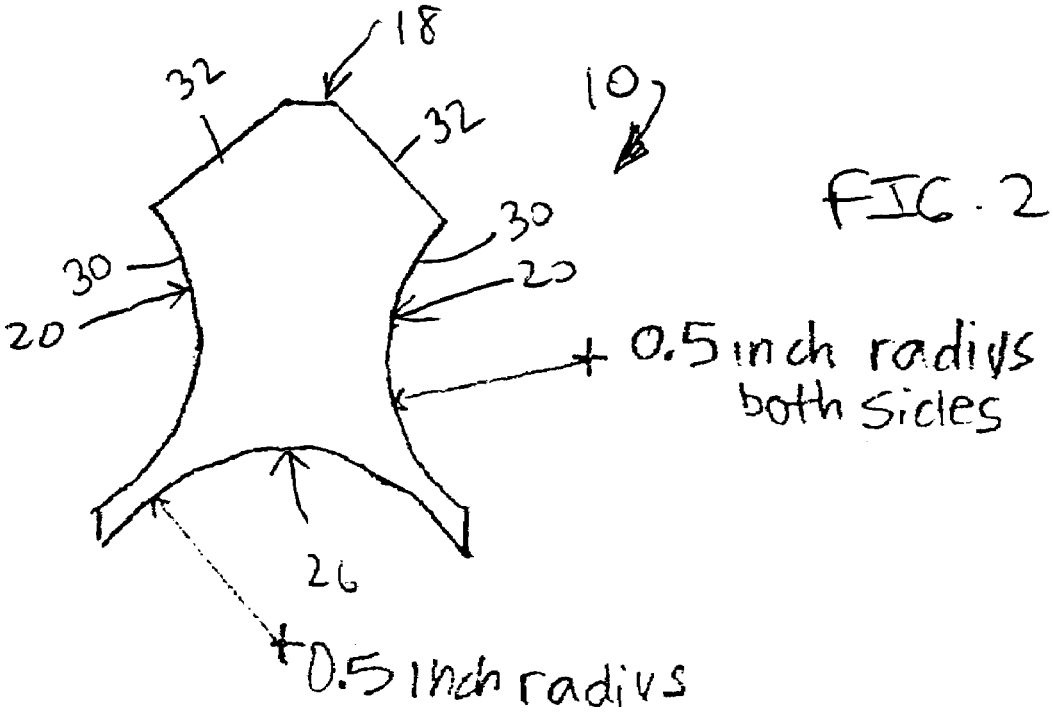
FIG. 2 is an elevational front view illustrating the ergonomic thimble, constructed in accordance with the present invention.
Figure 3:
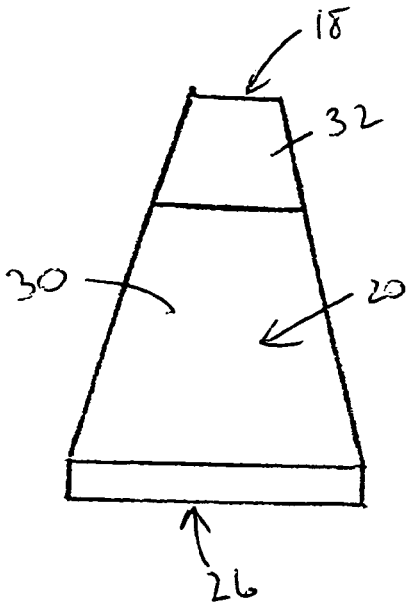
FIG. 3 is an elevational side view illustrating the ergonomic thimble, constructed in accordance with the present invention.

As best illustrated in FIGS. 1-3, the ergonomic thimble 10 of the present invention has a top needle bearing surface 18, two side surfaces 20, a front surface 22, a rear surface 24, and a bottom surface 26. Preferably the top needle bearing surface 18 has an indented or concave dimple 28 for receiving an eye end of the needle 12. The dimple 28 is sized and shaped to maintain the eye end of the needle 12 therein during sewing operations.

The side surfaces 20 of the ergonomic thimble 10 of the present invention each include a curved portion 30 adjacent the bottom surface 26 and an angled portion 32 adjacent the top needle bearing surface 18. The curved portion 30 of the side surfaces 20 are sized and shaped for receiving the fingers of the user when the ergonomic thimble 10 is seated between the fingers. Preferably, the curved portions 30 of the side surfaces 20 are curved with an approximately 0.5 inch curve radius. While the curved portions 30 of the side surfaces 20 have been described as having an approximately 0.5 inch curve radius, it is within the scope of the present invention for the curved portions 30 of the side surfaces 210 to have a curve radius greater than or less than approximately 0.5 inch.

The bottom surface 26 of the ergonomic thimble 10 of the present invention is curved for receiving the thumb of the user when the ergonomic thimble 10 is seated between the fingers. Preferably, the bottom surface 26 is curved with an approximately 0.5 inch curve radius. Like the side surfaces 20, while the bottom surface 26 has been described as having an approximately 0.5 inch curve radius, it is within the scope of the present invention for the bottom surface 26 to have a curve radius greater than or less than approximately 0.5 inch.

The front surface 22 and the rear surface 24 of the ergonomic thimble 10 of the present invention are angled inward from the bottom surface 26 to the top needle bearing surface 18 such that the area of the bottom surface 26 is greater than the area of the top needle bearing surface 18. Angling of the front surface 22 and the rear surface 24, together with the angled portions 32 of the side surfaces 20, allows the top needle bearing surface 18 to maneuver into tight, small spaces as may be required during sewing operations.

Operation and use of the ergonomic thimble 10 of the present invention will now be described. It will be understood by those persons skilled in the art that the following description is merely one manner of operating and using the ergonomic thimble 10 and other manners of use are within the scope of the present invention.

Figure 4:
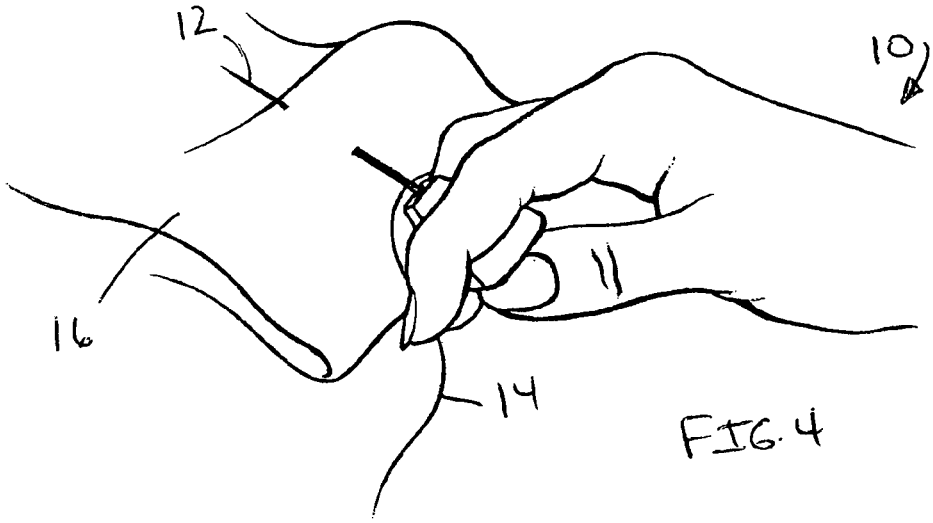
FIG. 4 is a perspective view illustrating the ergonomic thimble, constructed in accordance with the present invention, with the ergonomic thimble being used to push a needle through fabric.

As illustrated in FIG. 4, the ergonomic thimble 10 is positioned between the index finger and middle finger of the desired hand with the curved portion 30 of one of the side surfaces 20 receiving the user's index finger and the curved portion 30 of the other side surface 20 receiving the user's middle finger. The user's thumb is then seated into the curved bottom surface 26 of the ergonomic thimble 10. With the ergonomic thimble 10 seated between the fingers, the eye end of the needle 12 is seated in the dimple 28 formed in the top needle bearing surface 18. At this point, the ergonomic thimble 10 can be used to apply pressure to the needle 12 to force the needle 12 through the fabric 16.

Figure 5:
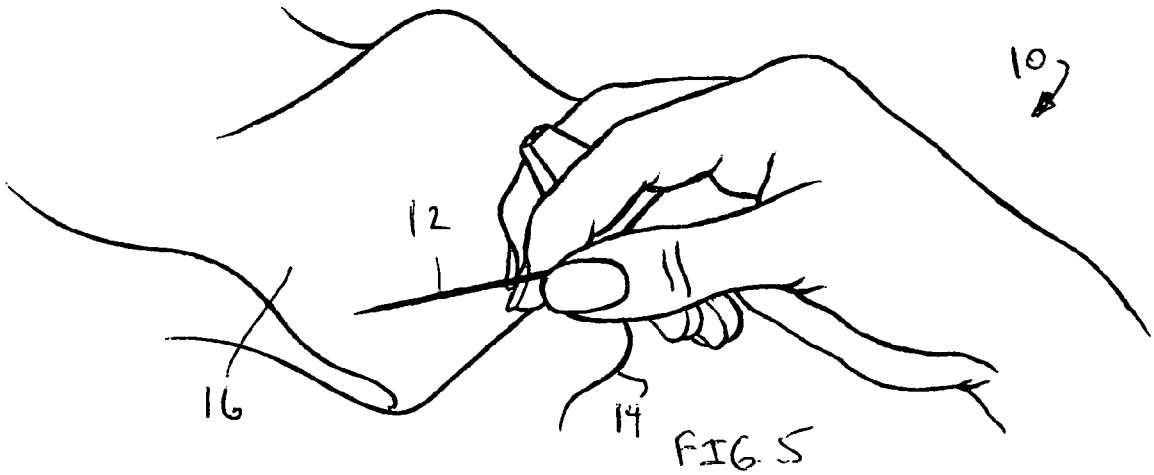
FIG. 5 is a perspective view illustrating the ergonomic thimble, constructed in accordance with the present invention, with the ergonomic thimble being maintained in the user's hand while the user manipulates a needle.

As illustrated in FIG. 5, once the needle 12 has been forced through the fabric 16, the user's thumb is removed from its seating in the curved bottom surface 26. By simply removing the thumb from the bottom surface 26, all of the user's fingertips are available for further maneuvering of the needle 12, thread 14, and/or fabric 16. Sewing is accomplished unimpeded by the ergonomic thimble 10 which remains firmly seated between the index finger and the middle finger of the user.

The ergonomic thimble 10 of the present invention allows the user to keep the needle 12 in hand and wear the ergonomic thimble 10 with the dominant hand for better maneuverability while keeping the other hand free to hold and manipulate the fabric 12 or project with maximum efficiency. The ergonomic thimble 10 is constructed from a durable material and can be reused over and over again. In sum, the ergonomic thimble 10 of the present invention is more comfortable than a conventional thimble while increasing the efficiency of the sewing project.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A thimble device for protecting fingers and a thumb from a needle during a sewing operation, each finger having a tip and at least one side facing an adjacent finger, the thumb having a tip and at least one side surface, the thimble device comprising:

a top needle bearing surface;

a first side surface and a closed second side surface, each side surface having a concave portion, the first side surface receiving a portion of the side of a first finger and the second side surface receiving a portion of the side of an adjacent second finger;

a front surface;

a rear surface; and a closed bottom surface;

wherein the thimble device is grippable between the sides of the adjacent first finger and the second finger with the thumb restable against the closed bottom surface; and wherein the tips of the fingers and the thumb are free from being covered by the thimble device.

2. The thimble device of claim 1 wherein the top needle bearing surface includes a dimple formed therein.

3. The thimble device of claim 2 wherein the dimple formed on the top needle bearing surface is sized and shaped for receiving an eye end of the needle.

4. The thimble device of claim 1 wherein the side surfaces further include an angled portion, the angled portion of the side surfaces being adjacent the top needle bearing surface and the concave portions of the side surfaces being adjacent the bottom surface.

5. The thimble device of claim 1 wherein the concave portions of the first side surface and the second side surface are concavoconcave surfaces sized and shaped for receiving the sides of two adjacent fingers when the ergonomic thimble is seated between the adjacent fingers.

6. The thimble device of claim 5 wherein the side surfaces are concave with an approximately 0.5 inch radius.

7. The thimble device of claim 1 wherein the bottom surface is concave for receiving a side surface of the thumb only when the ergonomic thimble is seated between the fingers.

8. The thimble device of claim 7 wherein the bottom surface is concave with an approximately 0.5 inch radius.

9. The thimble device of claim 1 wherein the front surface and the rear surface are tapered inward from the bottom surface to the top needle bearing surface such that the area of the bottom surface is greater than the area of the top needle bearing surface.

10. A thimble device for protecting fingers and thumb from a needle during a sewing operation, each finger having a tip and at least one side facing an adjacent finger, the thumb having a tip and at least one side surface, the thimble device comprising:

a top needle bearing surface having a dimple formed therein;

two side surfaces, each side surface having a tapered portion and a concave portion, the side surfaces being concavoconcave surfaces, the concave portions sized and shaped for gripping between the sides of adjacent fingers when the thimble device is seated between the fingers distant from the tips of the fingers;

a tapered front surface;

a tapered rear surface; and a closed, curved bottom surface sized and shaped for receiving a portion of the side of the thumb, the tip of the thumb free from covered by the thimble device.

11. The thimble device of claim 10 wherein the dimple formed on the top needle bearing surface is sized and shaped for receiving an eye end of the needle.

12. The thimble device of claim 1 wherein the tapered portion of the side surfaces is adjacent the top needle bearing surface and the concave portions of the side surfaces are adjacent the bottom surface.

13. The thimble device of claim 10 wherein the side surfaces are concave with an approximately 0.5 inch radius.

14. The thimble device of claim 10 wherein the bottom surface is concave with an approximately 0.5 inch radius.

15. The thimble device of claim 10 wherein the front surface and the rear surface are tapered inward from the bottom surface to the top needle bearing surface such that the area of the bottom surface is greater than the area of the top needle bearing surface.

16. A method for using a thimble device of claim 10 for protecting a hand during sewing operations, the hand having an index finger, a middle finger, and a thumb, the method comprising:

positioning the thimble device between the index finger and the middle finger;

resting a portion of the side of the index finger against the concave portion of one of the side surfaces;

resting a portion of the side of the middle finger against the concave portion of the other side surface;

seating a portion of the thumb against the concave bottom surface;

positioning an eye end of the needle in the dimple; and applying pressure to the needle.

17. The method of claim 16 and further comprising:

removing the thumb from against the curved bottom surface; and maintaining the thimble device between side surfaces of the middle finger and the index finger.

18. The method of claim 16 wherein the side surfaces are curved with an approximately 0.5 inch radius.

19. The method of claim 16 wherein the bottom surface is curved with an approximately 0.5 inch radius.

20. The method of claim 16 wherein the front surface and the rear surface are tapered inward from the bottom surface to the top needle bearing surface such that the area of the bottom surface is greater than the area of the top needle bearing surface.

* * * * *